United States Patent [19]

Beraud et al.

[11] 4,095,403

[45] Jun. 20, 1978

[54] METHOD OF MAKING FANCY YARN AND FANCY YARN

[75] Inventors: Claudius Beraud, Tassin; Robert Guigal, Lyons; Robert Lehmann, L'Arbresle; André Lyonnet, Lyons, all of France

[73] Assignees: Institut Textile de France, Boulogne sur Seine; Agence Nationale de Valorisation de la Recherche (ANVAR), Neuilly sur Seine, both of France

[21] Appl. No.: 788,914

[22] Filed: Apr. 19, 1977

[30] Foreign Application Priority Data

Apr. 20, 1976 France ..... 76 11646

[51] Int. Cl.[2] ..... D02G 3/38; D02G 3/40

[52] U.S. Cl. ..... 57/144; 57/140 BY; 57/140 J; 57/157 TS; 57/162; 156/148; 156/172

[58] Field of Search ..... 57/144, 149, 153, 140 BY, 57/140 J, 140 C, 160, 162, 164, 157 TS; 156/148, 172

[56] References Cited

U.S. PATENT DOCUMENTS

| | | | |
|---|---|---|---|
| 3,763,640 | 10/1973 | Nagel et al. | 57/160 X |
| 3,844,103 | 10/1974 | Sasaki et al. | 57/160 X |
| 3,868,812 | 3/1975 | Chaten | 57/160 X |
| 3,924,396 | 12/1975 | Bobkowicz et al. | 57/164 X |
| 3,949,544 | 4/1976 | Kitazawa et al. | 57/140 BY X |

*Primary Examiner*—Richard C. Queisser
*Assistant Examiner*—Charles Gorenstein
*Attorney, Agent, or Firm*—Arnold, White & Durkee

[57] ABSTRACT

The invention relates to fancy yarns, and a method of making them, in which at least two yarns, of which one forms a core and one an effect yarn, are fed to a junction point and then fed together through a heat treatment zone and assembled into the fancy yarn in a false twisting step, the core yarn having been provided with a thermoplastic binder upstream of the junction point by which the effect yarn is adhered to the core yarn.

19 Claims, 5 Drawing Figures

METHOD OF MAKING FANCY YARN AND FANCY YARN

The present invention relates to a method of making a fancy yarn and to fancy yarns.

The invention relates more particularly to a method of making, from at least two yarns of which one forms the core, and one is the "effect" yarn giving the fancy effect, fancy yarns which exhibit localised effects, such as flakes, knops or loops, and fancy yarns which have a fibrous or fluffy or bulky appearance.

Numerous techniques are known for producing fancy yarns. For those yarns which exhibit localised effects over their length, the most widespread technique, which is described in French Pat. Nos. 2,080,051 and 2,080,052, consists of winding at least one effect yarn around a core yarn, for example using a twisting frame comprising several pairs of feed rollers or a hollow-spindle throwing frame optionally equipped with means for imparting a false twist. By varying the feed rate of the effect yarn relative to the core yarn and/or the wind-up speed and/or by using a lapping needle, it is possible to obtain a great variety of fancy yarns. This technique, however, suffers from disadvantages, the main ones being a very low production speed and the need to use a further binding, yarn to obtain a fancy yarn which is stable.

In order to increase production speed, it has been proposed to assemble the core yarn and the effect yarn by false twisting, optionally causing them to undergo a heat treatment before and/or after passing through the false-twist device. Such a technique is described in French Pat. No. 2,196,408. However, with this technique, it is virtually impossible to obtain stability of the effect yarn unless again a binding yarn is used.

Other recent techniques make it possible to obtain fancy yarns having a fibrous, fluffy appearance, and to do so from multi-filament synthetic yarns. Thus, it has been proposed, for instance, in French Pat. No. 2,114,216, to obtain a yarn having the appearance of a spun fibre yarn, from a yarn of two-component filaments of the core/sheath type, the material forming the sheath having a melting point below that of the material forming the core. According to this process, the yarn is subjected to a treatment comprising twisting, heat-setting and untwisting, if necessary completed by a second heat treatment, the setting temperature being at least equal to the softening point of the constituent having the lower softening point. Consequently, a certain number of filaments are glued to one another at various points, and define free portions which provide the effect. These free portions can be broken by the action of an abrasive device which makes it possible to obtain a fibrous or even a fluffy appearance.

Another process consists of gluing fibres onto a core, for example during extrusion of a synthetic yarn, whilst the polymer is still in the tacky state.

Whilst these processes make it possible to produce fancy yarns having a fibrous appearance, they lack flexibility and are expensive because they require either a particular starting material (a composite yarn) or a specific piece of equipment.

According to the present invention there is provided a method of making a fancy yarn in which at least two yarns, of which one forms a core and one an effect yarn, are fed to a junction point and then fed together through a heat-treatment zone and assembled into the fancy yarn in a false twisting step, and wherein the core yarn is provided with a termoplastic binder upstream of the junction point, the heat treatment in the zone being such as to develop the hot-melt adhesive properties of the thermoplastic binder.

This allows economical production of both fancy yarns exhibiting stable localised effects and fancy yarns having a fibrous or fluffy appearance. No binding yarn is required.

The invention also provides a fancy yarn including at least two yarns of which one forms a core and one an effect yarn, the yarns being assembled by false twisting and adhered to each other with a thermoplastic binder.

It is possible to use a binder other than a thermoplastics binder and, if appropriate, to dispense with the heat treatment step.

The core yarn and effect yarn can be any multifilament yarn or spun yarn, consisting of a natural and/or synthetic material, and these yarns may or may not be texturised beforehand.

The only requirement in choosing the core yarn and effect yarn is that the temperature required to develop the adhesive properties of the thermoplastic binder should be withstood by the yarns.

Desired fancy effects can be obtained in the conventional ways, for example by positively or non-positively, uniformly or non-uniformly, overfeeding the effect yarn relative to the core yarn and/or by passing the yarn produced over an abrasive device and/or by mixing different materials to obtain dyeing effects.

Compared to the earlier fancy yarns, the yarns according to the invention are characterised in that the effect yarn is permanently fixed on the core by means of the binder.

The application of the thermoplastic binder to the core can be effected in various different ways.

Thus, in one embodiment, this thermoplastic adhesive is in the form of a yarn which is fed in parallel with the core yarn, this yarn being a multifilament yarn or a spun fibre yarn. In another embodiment, the binder used is fluid and is coated on the core yarn.

As stated above, the choice of the thermoplastic binder will affect the choice of effect yarn and core yarn.

In general, materials having a low melting point and low softening point will be preferred as the thermoplastic binder. For example, where the thermoplastic binder is in the form of a yarn, it is possible to use, with advantage, polyamide 11, the tack point of which is at about 175° C, polypropylene, the tack point of which is at about 150° C, polyethylene, the tack point of which is at about 120° C, and, if desired, a polyester of low tack point, for example the polyester known under the name of polyester 4 GT, the tack point of which is about 200° C. Where the thermoplastic binder is in the fluid state, an aqueous emulsion of linear polyurethane will advantageously be used, but of course other types of binders can also be used.

The invention can easily be carried out on conventional single-oven or double-oven false twist texturising frames, these frames being optionally equipped, firstly, with feed means which allow the effect yarn to be fed and, secondly, either with a coating device or with supplementary carriers for storing the thermoplastic binder yarn.

In order that the invention may be better understood, examples are given below, without implying any limitation, and are illustrated in the accompanying drawings, in which.

Figure 1:
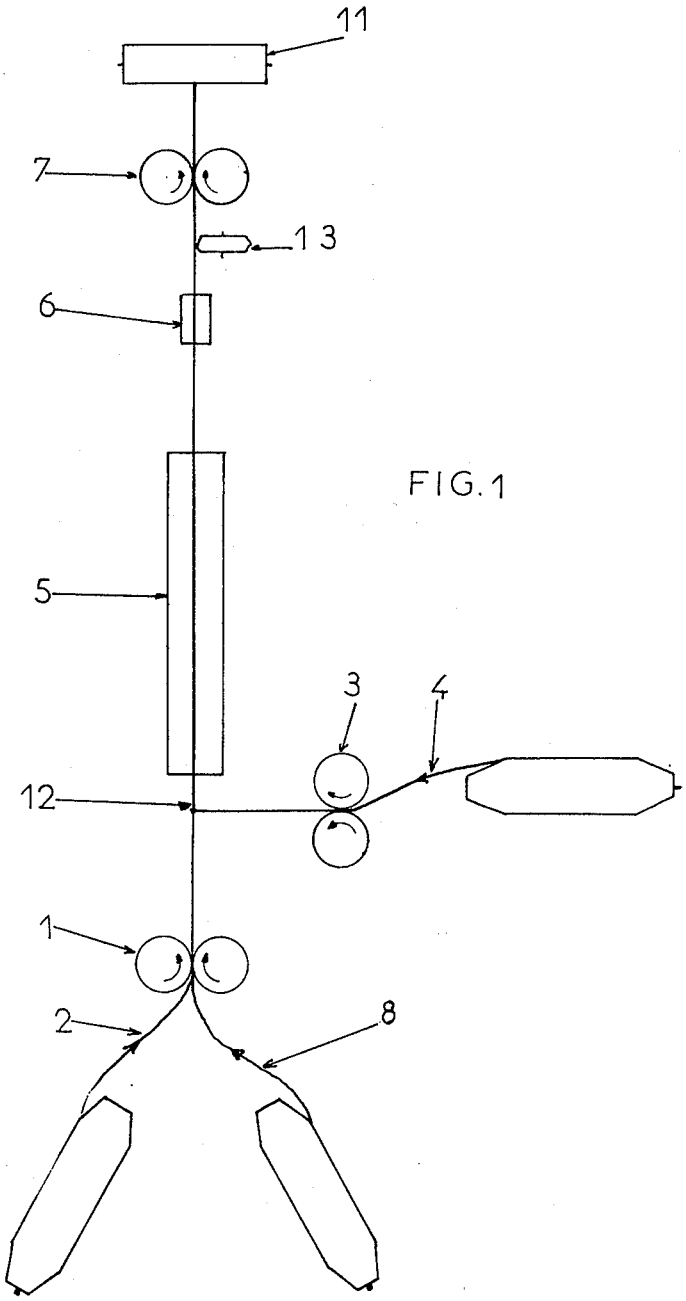
FIG. 1 illustrates the production of a fancy yarn by the method of the invention with the thermoplastics binder supplied in the form of a yarn.

As is shown schematically in the Figures, a device for carrying out the process according to the invention essentially comprises:

- feed means 1 for a core yarn 2, for example a feeder of the strap type or of the pressure roller type;
- feed means 3 for an effect yarn 4, which may or may not be of the same type as the feed means 1, these feed means 3 being optional;
- a heat treatment element 5, such as a contact oven, heated by electricity or in any other way;
- a false-twist spindle 6, of for instance the mechanical, magnetic or friction type;
- draw-off means 7 for the fancy yarn formed, and of a type similar to the feed means 1; and
- a conventional wind-up device 11.

In the first embodiment, illustrated in FIG. 1, the thermoplastics binder is supplied in the form of a yarn 8 which is brought in at the feed means 1 to run parallel with the core yarn 2.

Figure 2:
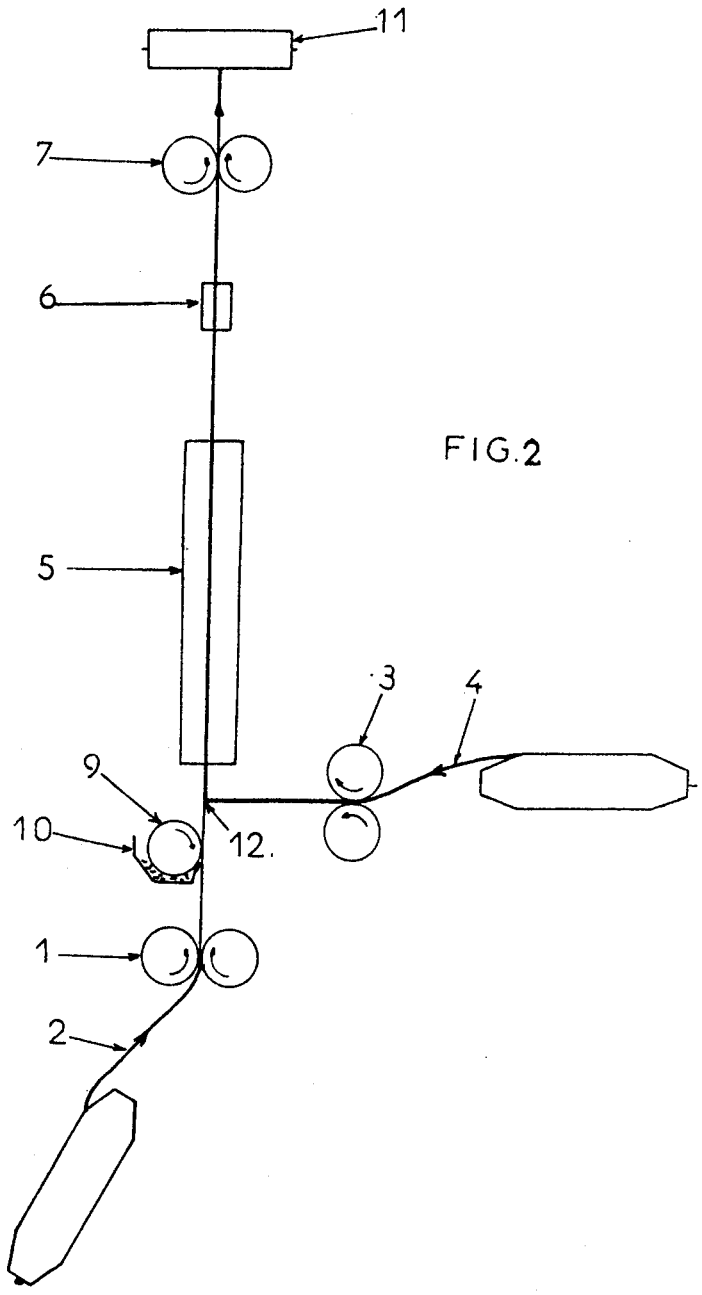
FIG. 2 illustrates the production of a fancy yarn by the method of the invention with the thermoplastics binder supplied as a coating.

In the second embodiment, illustrated in FIG. 2, the adhesive binder is contained in a tank 10 located between the feeder 1 and the junction point 12 of the effect yarn 4 with the core yarn 2 and is deposited on the core yarn 2 by a coating cylinder 9 partially immersed in the adhesive in the tank.

EXAMPLE 1

As illustrated in FIG. 1, a fancy yarn is formed by the false twist assembly of a core yarn 2 and an effect yarn 4, both consisting of polyamide 6,6, of 78 decitex gauge, comprising 23 strands, twisted at 20 turns in the Z-direction, non-shrunk, semi-matt and of round cross-section.

The thermoplastic binder yarn 8 consists of polyamide 11, of 32 decitex gauge, comprising 10 strands, twisted at 20 turns in the Z-direction, non-shrunk, semi-matt and of round cross-section.

The speed of the false-twist spindle 6, which is mechanical, is 75,000 revolutions per minute. This spindle is of the crossed bars type (type S.K.F., diameter 8).

The draw-off speed of the core yarn and of the fancy yarn formed is 32 meters/minute (zero overfeed).

The speed of the effect yarn 4 is about 38 meters/minute; in this case, the effect yarn is not fed positively, that is to say it does not pass through a feeder 3. This effect yarn winds itself round the core yarn 1 and the binder yarn 8 by the false-twist effect. The effect yarn 4 is subjected to a very low tensile force of the order of 0.1 cN per tex and directed at right angles to the core yarn 2 and to the binder yarn 8, the junction point 12 being stabilised by means of a fixed guide eyelet which is not shown.

The temperature of the oven 5 is 200° C. The length of the oven 5 is 1 meter.

The resulting fancy yarn is about 225 decitex gauge.

Figure 3:
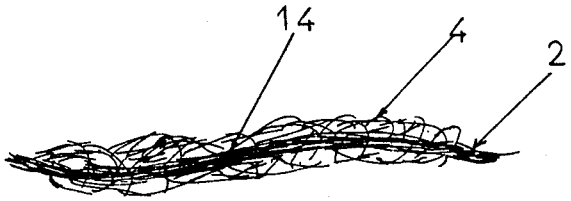
FIGS. 3, 4 and 5 schematically illustrate different types of yarns obtainable with the method of the invention, these being yarns according to the invention.

The fancy yarn obtained is illustrated schematically in FIG. 3 and exhibits a fibrous appearance, with the effect yarn 4 completely enveloping the core yarn 2 and being firmly bonded to the latter at points 14.

EXAMPLE 2

Example 1 is repeated, but instead of stabilising the junction point 12 of the effect yarn 4 with the core yarn 2 and the binder yarn 8, this junction point is allowed to move between the feed means 1 and the heat treatment element 5.

Figure 4:
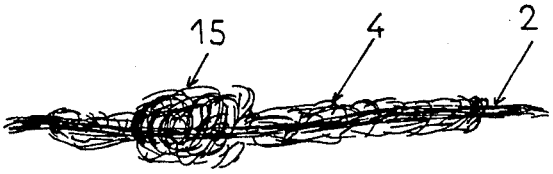

The yarn obtained, illustrated schematically in FIG. 4, exhibits an appearance which at one and the same time is fibrous and comprises knops. The effect yarn 4 completely and irregularly envelops the core yarn 2 and is firmly bonded to the latter. This yarn exhibits knop parts 15, the resulting fancy yarn obtained being about 215 decitex gauge.

EXAMPLE 3

Example 1 is repeated, but instead of using a mechanical false-twist spindle of the crossed bars type, an external friction spindle of the stacked disc type is used, allowing a higher production speed.

The speed of rotation of the discs is 5,500 revolutions per minute and the diameter of the said discs is 45 millimeters.

The draw-off speed of the core yarn 2 is 100 meters/minute and the speed of the feeder 7 is regulated to 104 meters/minute (an under-feed of 4%).

The speed of the effect yarn 4 is about 110 meters/minute.

The temperature of the oven 5 (length 1 meter) is 235° C.

The yarn obtained exhibits the same appearance as that of Example 1, illustrated in FIG. 3.

The resulting fancy yarn obtained is about 200 decitex gauge.

EXAMPLE 4

The preceding example is repeated, using the same core yarn and effect yarn, fed at the same speeds, and the yarn obtained is passed through a second heat treatment oven (not shown in the drawings), which is 50 centimeters long, is at a temperature of 210° C and is located after the false-twist spindle 6 in the direction of yarn movement. The draw-off means 7 placed after the second oven, is regulated so as to allow a shrinkage of 10%. The yarn obtained has increased bulkiness compared to the yarn of Example 3, and in addition it is more stable.

EXAMPLE 5

A fancy yarn is formed in the manner illustrated in FIG. 2 by false-twist assembly of a core yarn 2 and an effect yarn 4, both consisting of polyamide 6,6 of 78 decitex gauge, comprising 23 strands, twisted at 20 turns in the Z-direction, non-shrunk, semi-matt and of round cross-section.

The adhesive based on a 40% strength aqueous emulsion of a linear polyurethane, marketed under the trademark COESOL-US is deposited on the core yarn by means of the coating device 9.

The speed of rotation of the discs (diameter 45 millimeters) of the friction spindle is 3,600 revolutions per minute.

The draw-off speed of the core yarn 2 is 100 meters/minute and the speed of the feeder 7 is regulated to 104 meters/minute (an under-feed of 4%).

The speed of the effect yarn 4 is about 110 meters/minute.

The temperature of the oven 5 (length 1 meter) is 235° C.

The yarn obtained exhibits the same appearance as that of Example 1, illustrated in FIG. 3.

The resulting fancy yarn obtained is about 175 decitex gauge, 4% of which is accounted for by the CO-ESOL-US product.

EXAMPLE 6

A fancy yarn is formed in the manner illustrated in FIG. 1 by false-twist assembly of a core yarn 2 of polyamide 6,6, of 78 decitex gauge, comprising 17 strands, twisted at 20 turns in the Z-direction, non-shrunk, semi-matt, of round cross-section, and an effect yarn 4 of polyamide 6,6, of 167 decitex gauge, comprising 46 strands, texturised by a false-twist in the S-direction.

The thermoplastic binder yarn 8 consists of polyamide 11, of 32 decitex gauge, comprising 10 strands, twisted at 20 turns in the Z-direction, non-shrunk, semi-matt, of round cross-section.

The speed of the mechanical false-twist spindle (crossed bars type) is 75,000 revolutions per minute.

The draw-off speed of the core yarn 2 and of the fancy yarn formed is 32 meters/minute (zero overfeed).

The speed of the effect yarn 4 is about 38 meters/minute.

The process of feeding the effect yarn and the junction point with the core yarn and the binder yarn are the same as in Example 1.

The temperature of the oven 5 (length 1 meter) is 190° C.

The yarn obtained has a fibrous appearance, with the crimped effect yarn completely enveloping the core yarn and being firmly bonded to the latter.

EXAMPLE 7

Example 6 is repeated with the sole difference that after the false-twist spindle 6 and the feeder 7, the yarn is passed over an abrasive device 13 such as the rotatable wheel shown in FIG. 1.

Figure 5:
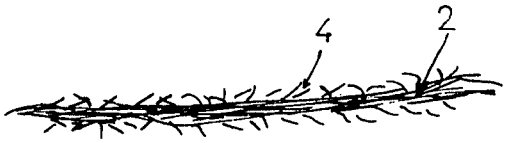

The yarn obtained, illustrated in FIG. 5, exhibits a very fibrous appearance, with the tousled and crimped effect yarn 4 completely enveloping the core yarn 2 and exhibiting broken strands as shown. The effect yarn is firmly bonded to the core yarn.

The resulting yarn is 340 decitex gauge.

EXAMPLE 8

A fancy yarn is formed in the manner illustrated in FIG. 1 by false-twist assembly of a core yarn 2 and of an effect yarn 4, the core yarn being a polyester yarn of 84 dtex gauge, comprising 15 strands, twisted at 20 turns in the Z-direction, the melting point of this yarn being 263° C, and the effect yarn is a spun fibre yarn of 250 dtex gauge (metric number Nm 40) based on an 85/15 polyester/linen mixture, twisted at 700 turns in the Z-direction.

The thermoplastic binder yarn 8 is a polyester yarn of low melting point, known by the name of polyester 4 GT, which has a tack point of about 200° C. This yarn has a gauge of 50 dtex, comprises seventeen strands and is twisted at 20 turns in the Z-direction.

As in Example 1, a mechanical false-twist spindle 6 of the crossed bars type (type S.K.F. diameter 8) is used, turning at a speed of (75,000) revolutions per minute.

The draw-off speed of the core yarn 2 is 40 meters per minute.

The speed of the effect yarn 4 is about 60 meters per minute; in this case the effect yarn is not fed positively, that is to say is does not pass through the feeder 3. The effect yarn is supplied in the same manner as in Example 1.

The temperature of the oven 5 is 215° C, the length of the oven being 1 meter.

The final gauge of the yarn obtained is, on average, 532 dtex.

The yarn has a fibrous irregular appearance, with the effect yarn completely enveloping the core yarn and being firmly bonded to the latter by the adhesive yarn. In this case, it is found that the effect yarn is held on the core yarn firstly by glue points and secondly by small broken strands which are formed on the adhesive yarn during the treatment.

EXAMPLE 9

Example 8 is repeated, but instead of stabilising the junction point 12 of the effect yarn 4 with the core yarn 2 and the adhesive yarn 8, the junction point is allowed to move between the feed means 1 and the heat treatment element 5.

In this case, the effect yarn is fed at an average speed of 90 meters per minute.

The yarn obtained exhibits parts with knops and flakes, firmly bonded to the core yarn.

Its average gauge is 606 dtex.

EXAMPLE 10

Example 8 is repeated, using the same core yarn and effect yarn, fed at the same speeds and the yarn obtained is passed through a second heat treatment oven (not shown), of 50 centimeters length, having a temperature of 140° C and located after the false-twist spindle 6. The draw off means placed after the second oven is regulated so as to allow a shrinkage of (4%) of the yarn.

The yarn obtained exhibits a similar effect to that of Example 8, but does not exhibit a twist reaction torque.

EXAMPLE 11

The yarn obtained in Example 8 is subjected to a treatment in an autoclave for 30 minutes at 130° C in saturated steam.

The properties of the yarn are slightly modified. It is notable that the yarn is stabilised and does not exhibit a twist reaction torque.

COMPARATIVE EXAMPLE

The preceding examples are repeated, but without using the thermoplastic binder. It is found that the yarns obtained do not exhibit any cohesion, and the core yarn and effect yarn can easily be separated by simply placing them under tension, or by rubbing.

Thus, the Examples 1 to 11 demonstrate the possibilities of the invention, which leads to various fancy yarns which exhibit stable effects and can be used in numerous applications, such as furnishing and clothing.

It is obvious that following the same principle it is possible to obtain varied effects, such as flakes, knops and the like, by varying, in a known manner the feed rate of the effect yarn or yarns relative to the core yarn.

We claim:

1. A method of making a fancy yarn in which at least two yarns, of which one forms a core and one an effect yarn, are fed to a junction point and then fed together through a heat-treatment zone and assembled into the fancy yarn in a false twisting step, and wherein the core yarn is provided with a thermoplastic binder upstream of the junction point, the heat treatment in the zone being such as to develop the hot-melt adhesive properties of the thermoplastic binder.

2. A method as claimed in claim 1, wherein the thermoplastic binder is in the form of a yarn supplied in parallel with the core yarn.

3. A method as claimed in claim 2, wherein the thermoplastic binder is a multifilament yarn.

4. A method as claimed in claim 2, wherein the thermoplastic binder is a spun fibre yarn.

5. A method as claimed in claim 2, wherein the thermoplastic binder is one of the group of multifilament yarns based on polyethylene, polypropylene, polyamide 11 and polyester.

6. A method as claimed in claim 1, wherein the thermoplastic binder is coated on the core yarn.

7. A method as claimed in claim 1, wherein the fancy yarn is subjected to a second heat treatment after the false-twisting step.

8. A method as claimed in claim 1 wherein the fancy yarn in subjected to an abrasion treatment.

9. A method as claimed in claim 1 wherein the core yarn and the effect yarn are multifilament synthetic yarns.

10. A method as claimed in claim 1 wherein at least the effect yarn is a spun fibre yarn.

11. A fancy yarn comprising at least two yarns of which one forms a core and one an effect yarn, the yarns being assembled by false twisting and adhered to each other with a thermoplastic binder.

12. A fancy yarn as claimed in claim 11, wherein the thermoplastic binder is in the form of a yarn.

13. A fancy yarn as claimed in claim 12 wherein the thermoplastic binder is a multifilament yarn.

14. A fancy yarn as claimed in claim 12, wherein the thermoplastic binder is a spun fibre yarn.

15. A fancy yarn as claimed in claim 12, wherein the thermoplastic binder is one of the groups of multifilament yarns based on polyethylene, polypropylene, polyamide 11 and polyester.

16. A fancy yarn as claimed in claim 11, wherein the thermoplastic binder is coated on the core yarn.

17. A fancy yarn as claimed in claim 11 wherein the core yarn and the effect yarn are multifilament synthetic yarns.

18. A fancy yarn as claimed in claim 11 wherein at least the effect yarn is a spun fibre yarn.

19. A method of making fancy yarn in which at least two yarns, of which one forms a core and one an effect yarn, are assembled into the fancy yarn in a false twisting step, and wherein the core yarn is provided with a binder upstream of the point at which the yarns come together to be fed together to be false twisted.

* * * * *